US009506378B2

(12) United States Patent
Sakane

(10) Patent No.: US 9,506,378 B2
(45) Date of Patent: Nov. 29, 2016

(54) VARIABLE VALVE TIMING CONTROL APPARATUS OF INTERNAL COMBUSTION ENGINE

(71) Applicant: HITACHI AUTOMOTIVE SYSTEMS, LTD., Hitachinaka-shi, Ibaraki (JP)

(72) Inventor: Taisuke Sakane, Atsugi (JP)

(73) Assignee: HITACHI AUTOMOTIVE SYSTEMS, LTD., Hitachinaka-Shi (JP)

( * ) Notice: Subject to any disclaimer, the term of this patent is extended or adjusted under 35 U.S.C. 154(b) by 0 days.

(21) Appl. No.: 14/658,471

(22) Filed: Mar. 16, 2015

(65) Prior Publication Data

US 2016/0069223 A1 Mar. 10, 2016

(30) Foreign Application Priority Data

Sep. 10, 2014 (JP) ..... 2014-183757

(51) Int. Cl.
*F01L 1/34* (2006.01)
*F01L 1/344* (2006.01)

(52) U.S. Cl.
CPC ..... *F01L 1/34* (2013.01); *F01L 1/3442* (2013.01); *F01L 2001/34456* (2013.01); *F01L 2001/34469* (2013.01); *F01L 2001/34479* (2013.01); *F01L 2001/34483* (2013.01); *F01L 2101/00* (2013.01); *F01L 2250/02* (2013.01)

(58) Field of Classification Search
CPC ..... F01L 1/34; F01L 1/3442; F01L 2001/34456; F01L 2001/34469; F01L 2001/34483
USPC ..... 123/90.15, 90.17
See application file for complete search history.

(56) References Cited

U.S. PATENT DOCUMENTS 8,651,077 B2 * 2/2014 Matsunaga ..... F01L 1/344 123/90.15
2005/0115526 A1 6/2005 Schneider
2013/0036992 A1 2/2013 Iwai et al.
2013/0036993 A1 2/2013 Nakamura
2013/0098320 A1 4/2013 Matsunaga

FOREIGN PATENT DOCUMENTS

EP 2 305 969 A1 4/2011
JP 2013036390 A 2/2013

* cited by examiner

*Primary Examiner* — Ching Chang
(74) *Attorney, Agent, or Firm* — Foley & Lardner LLP

(57) ABSTRACT

A variable valve timing control apparatus has a drive rotary member having therein working chambers; a vane rotor relatively rotatably housed in the drive rotary member and defining the working chambers as retard and advance working chambers; and a spring forcing the vane rotor in one rotation direction with respect to the drive rotary member. The vane rotor has a tubular portion formed with the vane rotor and protruding from a middle position of a side of the vane rotor and a recessed portion formed on an outer peripheral surface of the tubular portion. An engaging end of an outermost circumferential portion of the spring is engaged with the drive rotary member, an engaging end of an innermost circumferential portion of the spiral spring is engaged with the tubular portion, and part of the innermost circumferential portion is inserted in the recessed portion.

15 Claims, 8 Drawing Sheets

VARIABLE VALVE TIMING CONTROL APPARATUS OF INTERNAL COMBUSTION ENGINE

BACKGROUND OF THE INVENTION

The present invention relates to a variable valve timing control apparatus of an internal combustion engine, which variably controls open and closing timing of an intake valve and/or an exhaust valve of the engine in accordance with an engine operating condition.

As a related art variable valve timing control apparatus of an internal combustion engine, Japanese Unexamined Patent Application Publication No. 2013-36390 (hereinafter is referred to as "JP2013-36390") discloses a variable valve timing control apparatus applied at an intake valve side.

The variable valve timing control apparatus of JP2013-36390 has a timing sprocket to which a turning force is transferred from a crankshaft of an engine, a front plate which closes or covers a front opening of a cylindrical housing of the timing sprocket, a vane rotor which is rotatably housed in the housing and defines a retard working chamber and an advance working chamber in the housing, and a cover portion which is set, at a front end side of the front plate, spaced a slight distance apart from the front plate and whose crank-shaped middle part is fixed to the vane rotor. The variable valve timing control apparatus further has a spiral spring which is provided between the cover portion and the front plate, and whose one end is engaged with an outer circumferential portion side of the front plate and whose other end is engaged with a middle portion (a rotational bush) of the cover portion so as to wind around an outer circumferential surface of the middle portion (the rotational bush) of the cover portion.

The spiral spring forces the vane rotor by a spring force so that the vane rotor relatively rotates to an advanced angle side with respect to the timing sprocket. By controlling the intake valve open/closing timing to the advanced angle side, engine startability can be improved.

Further, the cover portion is formed so as to avoid the spiral spring being disengaged with the cover portion and coming off to a front side when the spiral spring is deformed (a shape of the spiral spring is changed) in a spiral widening direction or a spiral shrinking direction.

SUMMARY OF THE INVENTION

In the variable valve timing control apparatus in JP2013-36390, however, although the cover portion avoids the coming-off of the spiral spring, the cover portion is provided as a separate component from the vane rotor and is fixed to the vane rotor with a bolt in assembly.

Since the cover portion has to be made or manufactured as a separate component from the vane rotor, a manufacturing operation and an assembly operation become complicated, and cost increases.

The present invention was made in view of the above technical problems. An object of the present invention is to provide a variable valve timing control apparatus of the internal combustion engine, which can be manufactured with less component count than the related art variable valve timing control apparatus without losing the function of avoiding the coming-off of the spiral spring.

According to one aspect of the present invention, a variable valve timing control apparatus of an internal combustion engine, comprises: a drive rotary member to which a turning force is transmitted from an engine crankshaft and which has therein working chambers; a vane rotor relatively rotatably housed in the drive rotary member and defining the working chambers as a retard working chamber and an advance working chamber, the vane rotor having (a) a tubular portion that is formed integrally with the vane rotor and protrudes from a middle position of one end side in an axial direction of the vane rotor to an outside of the drive rotary member; and (b) a recessed portion that is formed on an outer peripheral surface of the tubular portion and is recessed in a radially inward direction on the outer peripheral surface of the tubular portion, the recessed portion having side wall surfaces on both sides in the axial direction of the recessed portion; and a spiral spring forcing the vane rotor all the time in one rotation direction with respect to the drive rotary member. And an engaging end of an outermost circumferential portion of the spiral spring is engaged with the drive rotary member, and an engaging end of an innermost circumferential portion of the spiral spring is engaged with the tubular portion, and a part of the innermost circumferential portion of the spiral spring is inserted in the recessed portion.

According to another aspect of the present invention, a variable valve timing control apparatus of an internal combustion engine, comprises: a cylindrical housing to which a turning force is transmitted from an engine crankshaft and which has a plurality of shoes formed on an inner circumferential surface of the housing so as to protrude in a radially inward direction; a vane rotor including (a) a rotor that is secured to a camshaft, the rotor having (i) an extending portion that is formed integrally with the rotor and protrudes from a middle position of one end side in an axial direction of the rotor to an outside of the housing; and (ii) an engagement groove that is formed on a part of an outer peripheral surface of the extending portion and is recessed in a radially inward direction on the outer peripheral surface of the extending portion throughout a predetermined circumferential direction range; and (b) a plurality of vanes that are formed on an outer circumferential surface of the rotor so as to protrude in a radially outward direction, the vanes defining a retard working chamber and an advance working chamber between the adjacent two shoes; and a spiral spring forcing the vane rotor all the time in one rotation direction with respect to the housing. And an engaging end of an outermost circumferential portion of the spiral spring is engaged with the housing, and an engaging end of an innermost circumferential portion of the spiral spring is engaged with the extending portion, and a part of the innermost circumferential portion of the spiral spring is inserted in the engagement groove.

The other objects and features of this invention will become understood from the following description with reference to the accompanying drawings.

DETAILED DESCRIPTION OF THE INVENTION

According to the present invention, it is possible to reduce the component count while avoiding the coming-off of the spiral spring.

Embodiments of a variable valve timing control apparatus of the present invention will be explained below with reference to the drawings. In the following description, the variable valve timing control apparatus (VTC) is applied to a variable valve system for an exhaust valve side of an internal combustion engine. However, the variable valve timing control apparatus can be applied to a variable valve system for an intake valve side of the internal combustion engine.

First Embodiment

Figure 1:
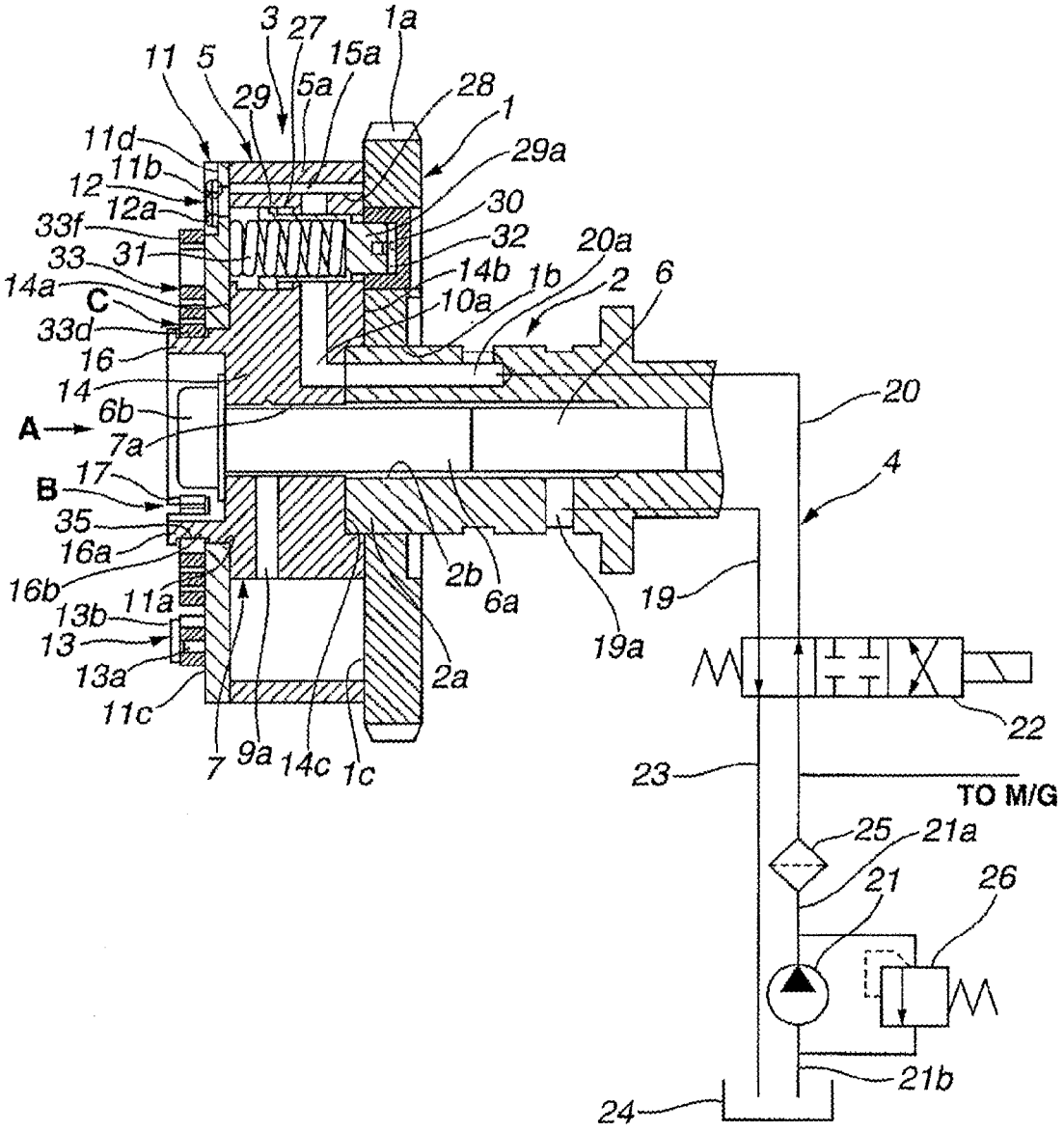
FIG. 1 is a sectional view showing a general block diagram of a variable valve timing control apparatus according to a first embodiment of the present invention.

As shown in FIG. 1, an exhaust side variable valve timing control apparatus has a sprocket 1 as a drive rotary member which is driven by an engine crankshaft (not shown) by a turning force transmitted through a timing chain, a camshaft 2 which is capable of rotating relative to the sprocket 1, a relative angular phase control mechanism (simply, a phase converter or a phase-change mechanism) 3 disposed between the sprocket 1 and the camshaft 2 and changing or controlling a relative rotational phase between the sprocket 1 and the camshaft 2, and a hydraulic circuit 4 which actuates the phase-change mechanism 3.

The sprocket 1 is made of iron base metal and is formed into a thick disk shape. The sprocket 1 has, at an outer periphery thereof, a gear wheel (or a toothed wheel) la around which the timing chain is wound and in the middle thereof, a penetration supporting hole 1*b* through which the sprocket 1 is rotatably supported by an outer periphery of the camshaft 2. Further, four female thread holes into which after-mentioned four bolts 12 are screwed respectively are formed at almost regular intervals in a circumferential direction on an outer peripheral area of the sprocket 1. The sprocket 1 serves as a rear cover 1*c* which covers a rear end opening of an after-mentioned housing 5.

The camshaft 2 is rotatably supported by a cylinder head (not shown) through a camshaft bearing. The camshaft 2 has a plurality of oval-shaped driving cams (rotation cams), each of which actuates an exhaust valve. Each driving cam is formed integrally with the camshaft 2 at a certain position in an axial direction on an outer peripheral surface of the camshaft 2. Further, the camshaft 2 is provided with a bolt insertion hole 2*b* in the axial direction at an inner side of one end portion 2*a* in order for a shaft portion 6*a* of a cam bolt 6 to screw in. Then, a female thread into which a top end male screw of the cam bolt 6 is screwed is formed at a top end portion of the bolt insertion hole 2*b*. An after-mentioned vane rotor 7 is secured to the camshaft 2 from the axial direction by the cam bolt 6.

Figure 2:
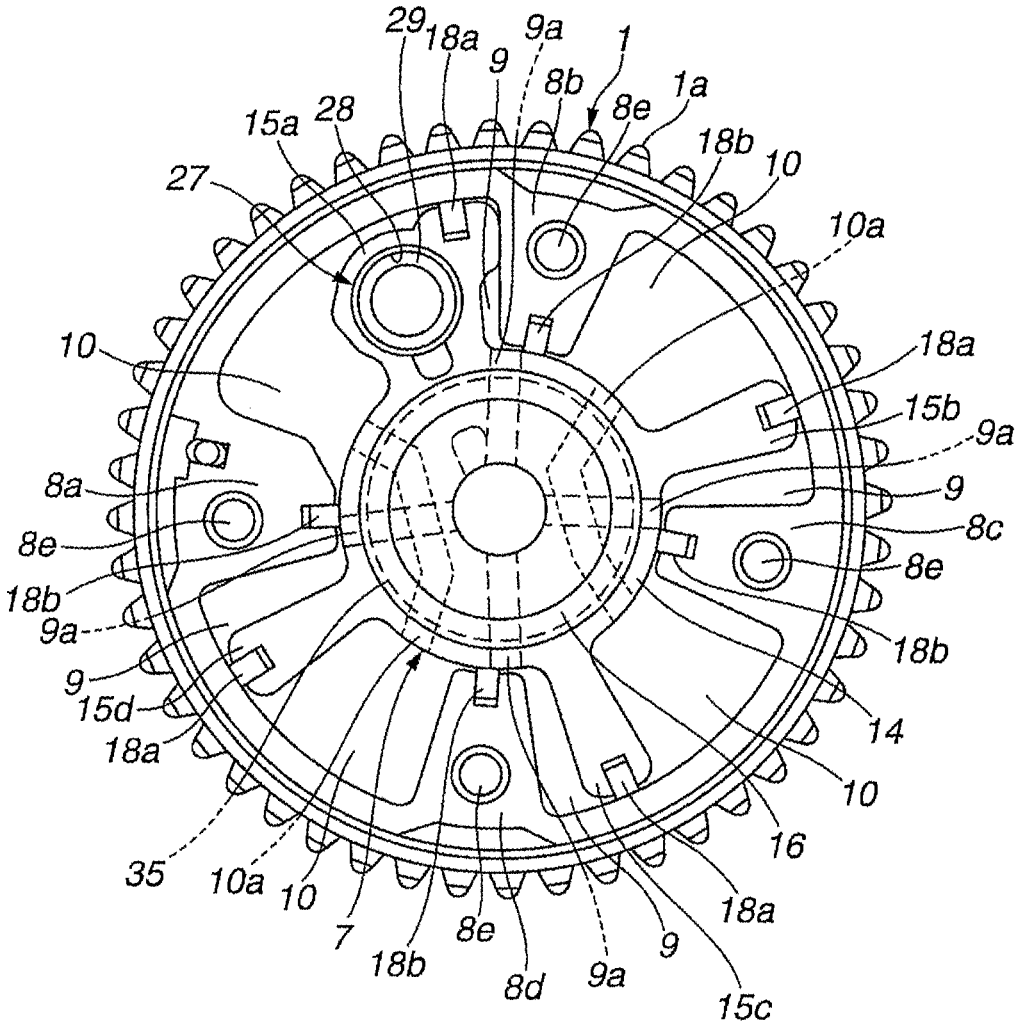
FIG. 2 is an explanatory drawing showing a state in which a vane rotor relatively rotates to an advanced angle side.
Figure 3:
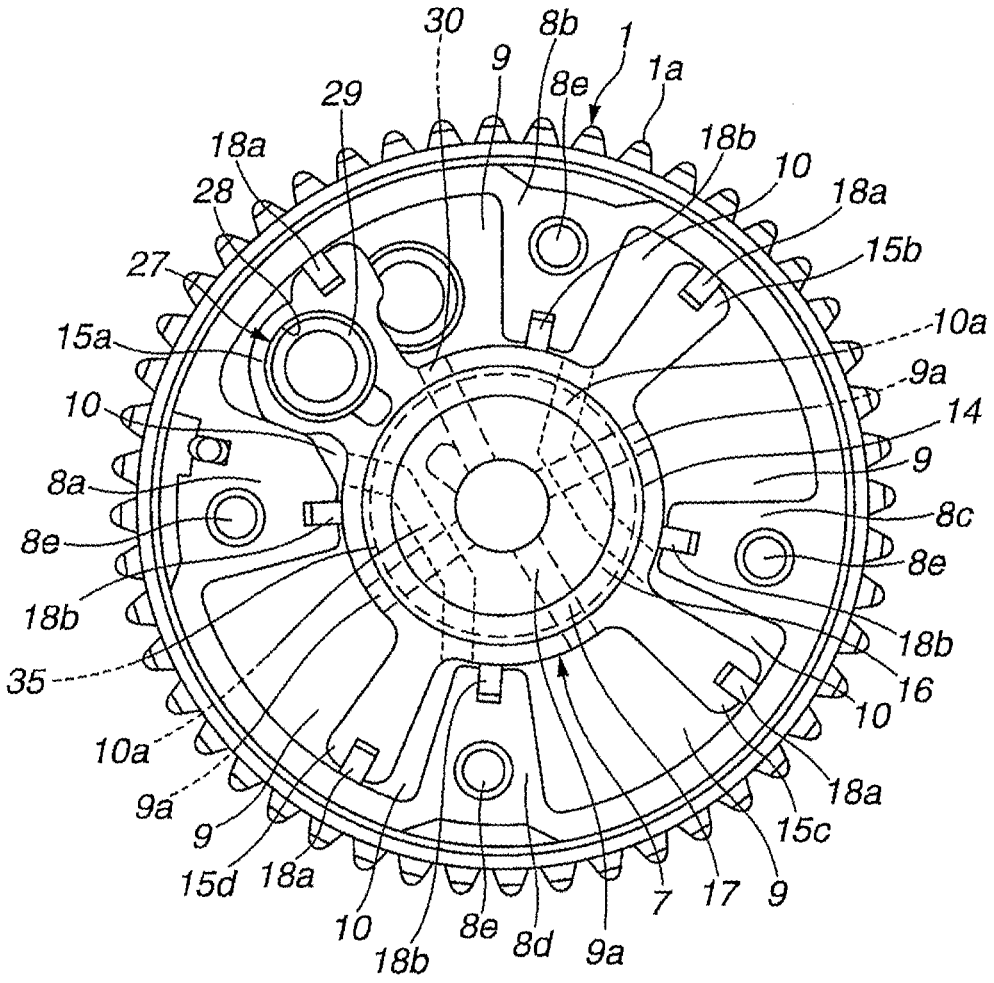
FIG. 3 is an explanatory drawing showing a state in which the vane rotor relatively rotates to a retarded angle side.

The phase-change mechanism 3 has, as shown in FIGS. 1 to 3, the housing 5 having working chambers inside the housing 5, the vane rotor 7 secured to the one end portion 2*a* of the camshaft 2 by the cam bolt 6 and relatively rotatably housed in the housing 5, four shoes 8 (first to fourth shoes 8*a* to 8*d*) formed integrally with an inner circumferential surface of an after-mentioned housing main body 5*a* of the housing 5, four retard oil chambers 9 that are retard working chambers and four advance oil chambers 10 that are advance working chambers. These oil chambers are defined by the vane rotor 7 in the housing 5.

The housing 5 is formed by the sintered metal-made cylindrical housing main body 5*a*, a front plate 11 that closes a front end opening of the housing main body 5*a* and the sprocket 1 as the rear cover 1*c* that covers the rear end opening of the housing 5. These housing main body 5*a*, front plate 11 and sprocket 1 are tightened together by the four bolts 12 that penetrate the respective bolt insertion holes 8*e* of the four shoes 8*a* to 8*d*, then fixedly connected together.

The front plate 11 is made of carbon steel and is formed into a disk shape. The front plate 11 is provided, in the middle thereof, with a penetration hole 11*a* having a relatively large diameter.

Figure 4:
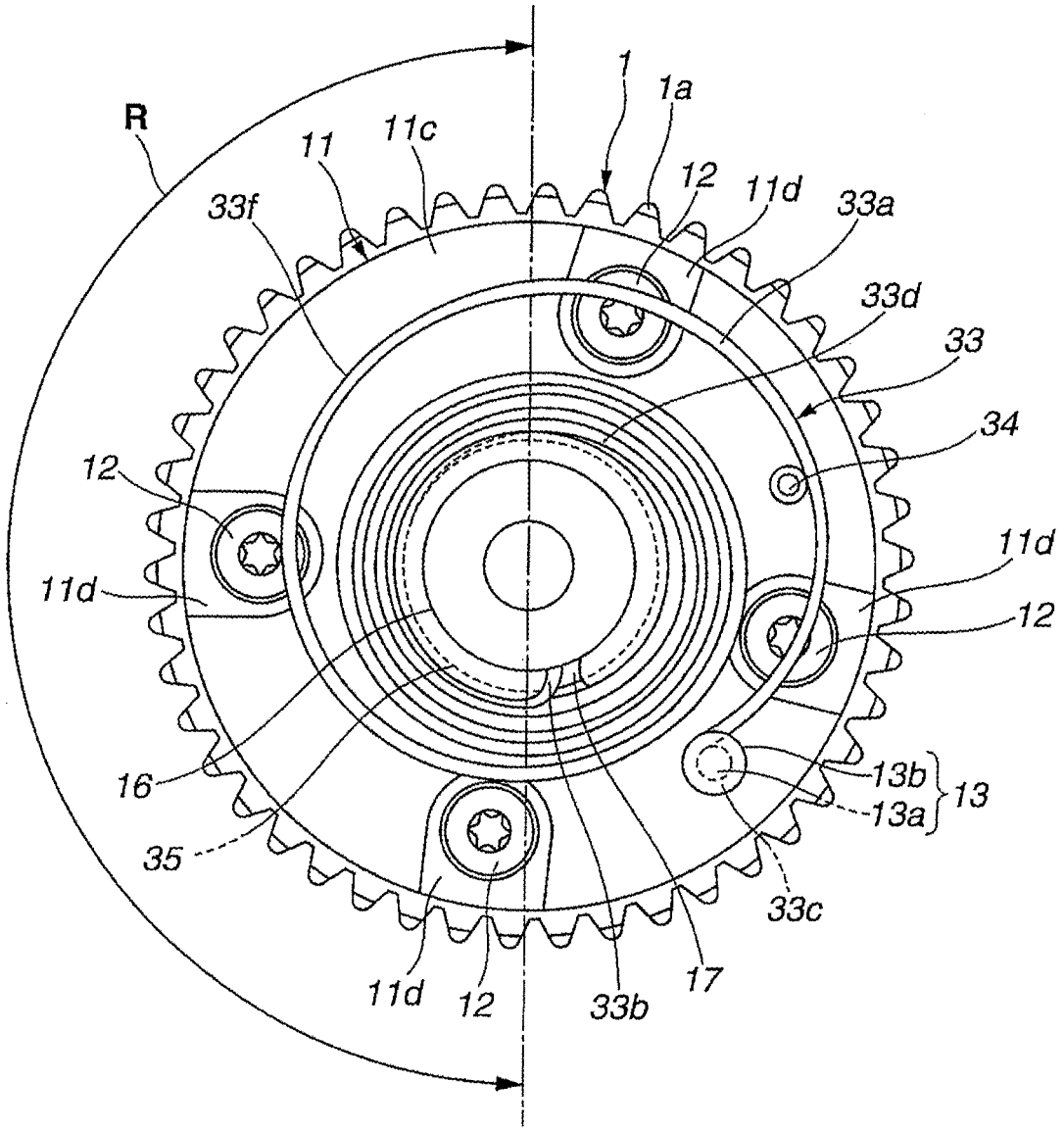
FIG. 4 is a front view, viewed from an arrow A of FIG. 1, of the variable valve timing control apparatus.

Further, as shown in FIGS. 1 and 4, the front plate 11 is provided, at regular intervals in a circumferential direction on an outer peripheral area thereof, with four bolt insertion holes 11*b* into which the respective bolts 12 are inserted. The bolt 12 is inserted into the bolt insertion hole 11*b* in the axial direction from an outer end surface 11*c* side of the front plate 11.

The outer end surface 11*c* of the front plate 11 is formed into a flat shape so that an inner side edge of an after-mentioned spiral spring 33 is contiguous to or touches the outer end surface 11*c*. That is, the outer end surface 11*c* acts as a seating surface of the spiral spring 33.

As can be seen in FIG. 4, in order that a head 12*a* of the bolt 12 inserted into the bolt insertion hole 11*b* does not interfere with the spiral spring 33 that is contiguous to the outer end surface 11*c*, namely, in order to ensure the abutted-contact between the spiral spring 33 and the outer end surface 11*c*, a countersunk portion 11*d* where a root of a shaft portion of the bolt 12 is fitted or seated is provided at a hole edge, at the outer end surface 11*c* side, of each bolt insertion hole 11*b*.

As shown in FIG. 4, this countersunk portion 11*d* has an arc shape whose diameter is greater than that of the head 12*a* of the bolt 12 with the bolt insertion hole 11*b* being a center, and a radially outward side of the countersunk portion 11*d* is formed into a long groove (a long hollow) that radially extends up to an outer circumferential edge of the front plate 11.

Further, as shown in FIGS. 1 and 4, at an outer circumferential side on the outer end surface 11*c* of the front plate 11, an umbrella pin 13 is press-fixed to the outer end surface 11*c* of the front plate 11 from the axial direction.

This umbrella pin 13 has a cylindrical pin body 13*a* and a disc-shaped umbrella portion 13*b* provided on a top surface of the pin body 13*a* which is an opposite side to a press-fixed side of the pin body 13*a*. An after-mentioned second engaging end 33*c* of the spiral spring 33 is wound around the pin body 13*a*, then is engaged with the pin body 13*a* (the umbrella pin 13).

The umbrella portion 13*b* has such diameter that the umbrella portion 13*b* covers almost the whole axial direction end surface of the second engaging end 33*c* wound around the pin body 13*a*, and avoids the second engaging end 33*c* of the spiral spring 33 coming off from the outer end surface 11*c* of the front plate 11.

The vane rotor 7 is formed as an integral member by sintered metal. As shown in FIGS. 1 to 3, the vane rotor 7 has a rotor 14 and four vanes (first to fourth vanes) 15*a* to 15*d*. The rotor 14 is secured to the camshaft 2 from the axial direction by the cam bolt 6 inserted into a bolt insertion hole 7*a* that is formed in the middle of the vane rotor 7. The four vanes 15*a* to 15*d* are arranged at almost regular intervals of 90° in a circumferential direction on an outer circumferential surface of the rotor 14, and protrude in a radial direction.

The rotor 14 is formed into a substantially cylindrical shape. The rotor 14 has, in the middle on a front end surface 14*a* thereof located at the front plate 11 side, a tubular protrusion 16 that is an extending portion formed integrally with the rotor 14 and having the same shaft center as the rotor 14.

Figure 6A:
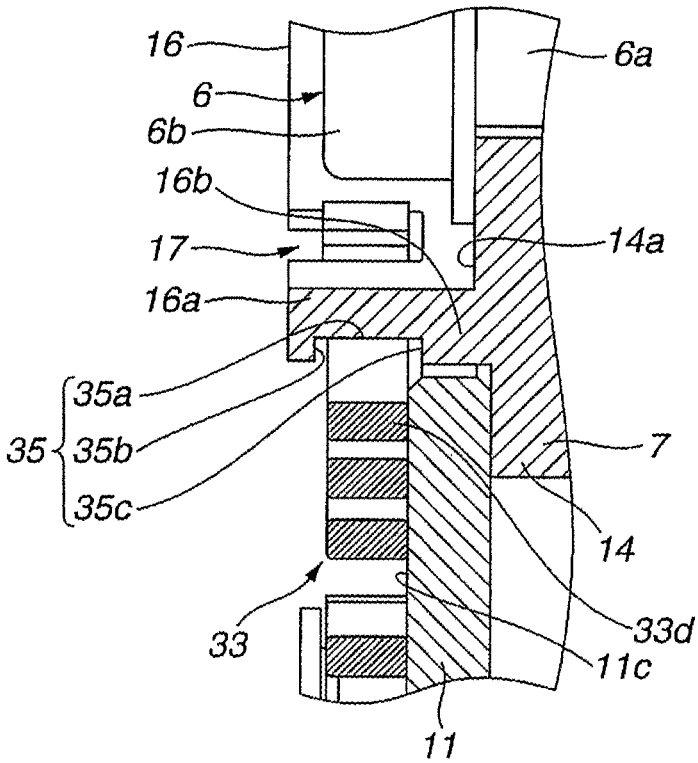
FIG. 6A is an enlarged view of a pointing line B of FIG. 1.
Figure 6B:
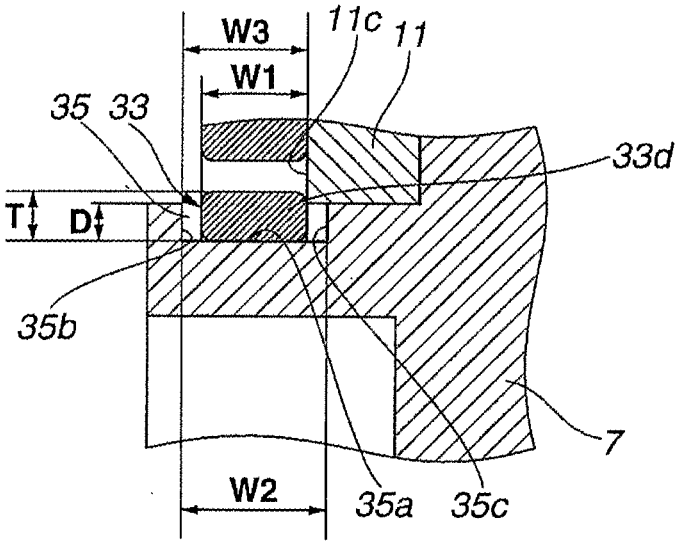
FIG. 6B is an enlarged view of a pointing line C of FIG. 1.

As shown in FIGS. 1, 6A and 6B, the tubular protrusion 16 is almost cylindrical in shape, and protrudes to the front side from the front end surface 14*a* of the rotor 14. More specifically, an outside diameter of the tubular protrusion 16 is set to be slightly smaller than an inside diameter of the penetration hole 11*a* of the front plate 11. A length in the axial direction of the tubular protrusion 16 is set to a predetermined length that is greater (longer) than a total length (a total width) of a plate thickness of the front plate 11 and an after-mentioned spring width W1 in the axial direction of the spiral spring 33.

With this setting, in assembly of the variable valve timing control apparatus, a top end portion 16*a* side of the tubular protrusion 16 protrudes from the housing 5 through the penetration hole 11*a* of the front plate 11.

Further, an inside diameter of the tubular protrusion 16 is set to be greater than an outside diameter of a head 6*b* of the cam bolt 6 so that the head 6*b* of the cam bolt 6 is accommodated inside the tubular protrusion 16 in the assembly.

Moreover, on an edge surface at the top end portion 16*a* side of the tubular protrusion 16, a stopper groove 17 that is a stopper portion with which an after-mentioned first engaging end 33*b* of the spiral spring 33 is engaged is formed.

Figure 5:
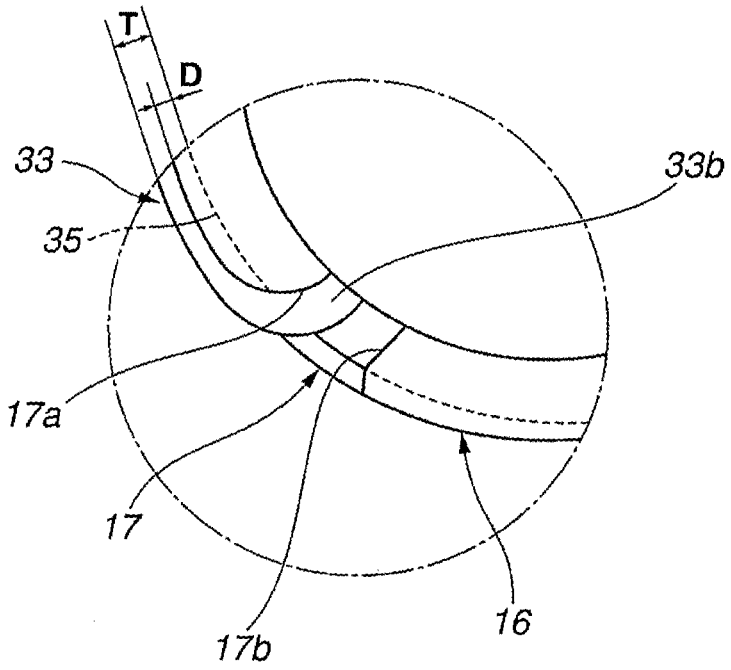
FIG. 5 is an enlarged view of a tubular protrusion of the vane rotor.

As shown in FIGS. 1, 5 and 6A, this stopper groove 17 is provided in a certain position in a circumferential direction of the tubular protrusion 16, and is formed by cutting an outer peripheral surface of the tubular protrusion 16 from an almost middle position to a top end edge of the outer peripheral surface toward a shaft center direction (a radial direction) of the tubular protrusion 16. The stopper groove 17 has opposing surfaces 17*a* and 17*b*, and the opposing surface 17*a* with which the first engaging end 33*b* of the spiral spring 33 is engaged is shaped into an arc surface.

The rotor 14 is provided, on a rear end surface 14*b* at the sprocket 1 side thereof, with a circular fitting groove 14*c* to which the one end portion 2*a* of the camshaft 2 is fitted.

The rotor 14 is installed so that the rear end surface 14*b* is in sliding-contact with an opposing inner end surface of the sprocket 1 with a minute or slight side clearance given between these surfaces. On the other hand, the rotor 14 is also installed so that the front end surface 14*a* is in sliding-contact with an opposing inner end surface of the front plate 11 with a minute or slight side clearance given between these surfaces. With this installation, sealing performance between the rotor 14 and the inner end surface of the sprocket 1 and between the rotor 14 and the inner end surface of the front plate 11 is ensured.

As shown in FIGS. 2 and 3, each of the first to fourth vanes 15*a* to 15*d* is placed between the adjacent two shoes of the shoes 8*a* to 8*d*. A seal groove is formed on an arc-shaped outer peripheral surface of each vane, and a seal member 18*a* is fitted in the seal groove. Each seal member 18*a* of the vane seals a gap between the outer peripheral surface of the vane and an inner circumferential surface of the housing main body 5*a* while making sliding contact with the inner circumferential surface of the housing main body 5*a*.

On the other hand, a seal groove is formed on a top end inner peripheral surface of each shoe 8 (the first to fourth shoes 8*a* to 8*d*), and a seal member 18*b* is fitted in the seal groove. Each seal member 18*b* seals a gap between the top end inner peripheral surface of the shoe 8 and the outer circumferential surface of the rotor 14 while making sliding contact with the outer circumferential surface of the rotor 14.

Here, both side surfaces located at both width direction sides (both rotor shaft direction sides) of each vane (the first to fourth vanes 15*a* to 15*d*) are in sliding-contact with the opposing inner end surface of the sprocket 1 and in sliding-contact with the opposing inner end surface of the front plate 11 with respective minute or slight side clearances given between these opposing surfaces. Also with this installation, sealing performance between each vane and the inner end surface of the sprocket 1 and between each vane and the inner end surface of the front plate 11 is ensured.

The first vane 15*a* is formed so as to have a widest fan shape among the four vanes, and also so as to be heaviest among the four vanes. The three vanes except the first vane 15*a*, i.e. the second to fourth vanes 15*b* to 15*d*, have almost the same width that is narrower (smaller) than that of the first vane 15*a*.

The vane rotor 7 is configured so that when the vane rotor 7 relatively rotates to a most-retarded angle side, as shown in FIG. 3, one side surface of the first vane 15*a* touches an opposing side surface of the first shoe 8*a* which faces the one side surface of the first vane 15*a* in the circumferential direction, then a rotation position at the most-retarded angle side of the vane rotor 7 is limited. Likewise, the vane rotor 7 is configured so that when the vane rotor 7 relatively rotates to a most-advanced angle side, as shown in FIG. 2, the other side surface of the first vane 15*a* touches an opposing side surface of the second shoe 8*b* which faces the other side surface of the first vane 15*a* in the circumferential direction, then a rotation position at the most-advanced angle side of the vane rotor 7 is limited.

These first vane 15*a*, first and second shoes 8*a* and 8*b* serve as a stopper that limits the most-retarded angle position and the most-advanced angle position of the vane rotor 7.

At this time (when the vane rotor 7 is positioned at the most-retarded angle position or the most-advanced angle position), with regard to the other vanes (the second to fourth vanes) 15*b* to 15*d*, both side surfaces of each vane do not touch the respective opposing surfaces of the shoes 8*a* to 8*d* which face the side surface of the second to fourth vanes 15*b* to 15*d* respectively in the circumferential direction, namely that the second to fourth vanes 15*b* to 15*d* are in a no-contact state with each shoe 8. Therefore, contact accuracy of the first vane 15*a* and the first and second shoes 8*a* and 8*b* is improved. In addition, a supply speed of hydraulic pressure to each of the retard and advance oil chambers 9 and 10 increases, thereby improving a forward/backward rotation response of the vane rotor 7.

Each of the retard oil chambers 9 and each of the advance oil chambers 10 communicate with the hydraulic circuit 4 through a first communication hole 9*a* and a second communication hole 10*a* that are formed along a radial direction at an inside of the rotor 14.

The hydraulic circuit 4 selectively supplies working fluid (the hydraulic pressure) in each of the retard and advance oil chambers 9 and 10 or discharges the oil supplied in the retard and advance oil chambers 9 and 10. As shown in FIG. 1, the hydraulic circuit 4 has a retard oil passage 19 that supplies/discharges the hydraulic pressure to/from each retard oil chamber 9 through the first communication hole 9*a*, an advance oil passage 20 that supplies/discharges the hydraulic pressure to/from each advance oil chamber 10 through the second communication hole 10*a*, an oil pump 21 that supplies the working fluid to the oil passages 19 and 20, and an electromagnetic switching valve 22 that switches a fluid passage of the retard oil passage 19 and the advance oil passage 20 in accordance with an engine operating condition.

The oil pump 21 is a generally used pump such as a trochoid pump that is driven by the engine crankshaft.

Each one end portion of the retard oil passage 19 and the advance oil passage 20 is connected to a passage port of the electromagnetic switching valve 22. Regarding the other end portion sides of the retard oil passage 19 and the advance oil passage 20, a retard oil passage portion 19*a* and an advance oil passage portion 20*a* are formed at an inside of the camshaft 2 with these oil passage portions 19*a* and 20*a* extending parallel to each other (parallel to the camshaft 2) in the axial direction through the cylinder head and/or a cylinder block (both not shown).

The retard oil passage portion 19*a* communicates with each retard oil chamber 9 through the first communication hole 9*a*, while the advance oil passage portion 20*a* communicates with each advance oil chamber 10 through the second communication hole 10*a*.

As shown in FIG. 1, the electromagnetic switching valve 22 is a two-position three-port valve. The electromagnetic switching valve 22 is configured to connect an oil outlet passage 21*a* of the oil pump 21 and either one of the oil passage 19 or 20 and also connect an oil drain passage 23 and the other of the oil passages 19 and 20 at the same time, by backward-and-forward motion of a spool valve body (not shown) that is provided slidably in an axial direction inside a valve body of the electromagnetic switching valve 22 by an electronic controller (not shown).

An oil inlet passage 21*b* of the oil pump 21 and the oil drain passage 23 each communicate with an oil pan 24. A filter 25 is provided at a downstream side of the oil outlet passage 21*a* of the oil pump 21, and a downstream side of the filter 25 communicates with a main oil gallery M/G that supplies lubricant to sliding parts in the engine. Further, the oil pump 21 is provided with an oil flow amount control valve 26 that controls the oil flow amount to a proper amount by discharging surplus working fluid that flows from the oil pump 21 to the oil outlet passage 21*a* to the oil pan 24.

The electronic controller has a computer, and inputs information signals from sensors such as a crank angle sensor, an airflow meter, an engine temperature sensor, a throttle valve opening sensor and a cam angle sensor that detects a current rotation phase of the camshaft 2 (all not shown), and detects a current engine operating condition. Further, the electronic controller outputs a control pulse current to an electromagnetic coil of the electromagnetic switching valve 22, and performs the switching control of each oil passage by controlling a position of the spool valve body (the motion of the spool valve body).

As shown in FIGS. 1 to 3, between the first vane 15*a* and the rear cover 1*c* of the sprocket 1, a locking mechanism 27 that restrains free rotation of the vane rotor 7 with respect to the housing 5 and locks the vane rotor 7 to the most-advanced angle position is provided.

This locking mechanism 27 has a lock pin 29 slidably housed or held in a sliding hole 28 that is formed at and penetrates the first vane 15*a* in an axial direction and freely moving toward or away from the rear cover 1*c* side, a locking hole 30 formed at a substantially middle position in a radial direction of the rear cover 1*c* and receiving therein a top end portion 29*a* of the lock pin 29 for engagement (for the lock of the vane rotor 7) or releasing therefrom the top end portion 29*a* for disengagement (for release of the lock of the vane rotor 7), and a locking/releasing mechanism engaging and disengaging the top end portion 29*a* of the lock pin 29 with and from the locking hole 30 in accordance with an engine start condition.

A shape of the lock pin 29 including the top end portion 29*a* is a substantially cylindrical shape by which the lock pin 29 can easily engages with the locking hole 30 from the axial direction. A coil spring 31 is provided between a hollow bottom of the lock pin 29, which is formed at an inside of the lock pin 29 from a rear end side of the lock pin 29 in the axial direction, and an inner surface of the front plate 11, then forces the lock pin 29 in a forward direction (in an engagement direction).

The locking hole 30 has a diameter that is greater than an outside diameter of the top end portion 29*a* of the lock pin 29, and is positioned, in the circumferential direction, at the retard oil chamber 9 side. This position is set so that when the lock pin 29 is engaged with the locking hole 30, a relative rotational angle position (a relative conversion angle position) between the housing 5 and the vane rotor 7 is the most-advanced angle side position.

Further, a semi-arc-shaped pressure-receiving space 32 whose diameter is smaller than an outside diameter of the lock pin 29 is formed in a position of a side portion of the locking hole 30, which is deeper than the locking hole 30 in the axial direction.

The locking/releasing mechanism has the coil spring 31 forcing the lock pin 29 in the forward direction (in the engagement direction) and a lock cancelling hydraulic circuit (not shown) that supplies a hydraulic pressure to the pressure-receiving space 32 in the locking hole 30 and moves the lock pin 29 in a backward direction (in a disengagement direction). This lock cancelling hydraulic circuit is configured so that a hydraulic pressure selectively supplied to the retard oil chamber 9 and the advance oil chamber 10 is supplied to the pressure-receiving space 32 through a certain oil hole then the lock pin 29 moves in the backward direction (in the disengagement direction).

As shown in FIGS. 1, 4 to 6A, 6B, the spiral spring 33 that forces the vane rotor 7 in an advanced angle direction with respect to the housing 5 is installed on the outer end surface 11*c* of the front plate 11.

The spiral spring 33 is a so-called plate spiral spring or plate helical spring. The spiral spring 33 is formed by being wound so that longitudinal direction both top and back surfaces of the spring face each other and so that when wound, flat one side of the spring having an almost rectangular cross-section is on the same one surface. The spiral spring 33 has a spiral spring body 33*a* having a spiral shape gradually widening or expanding from an inner circumferential side to an outer circumferential side, the first engaging end 33*b* formed by curving an innermost circumferential portion 33*d* of the spiral spring body 33*a* in a radially inward direction and the second engaging end 33*c* formed by curving an outermost circumferential portion 33*f* of the spiral spring body 33*a* in a radially outward direction so as to have a semi-circular hook shape.

Here, in the following explanation, for the sake of convenience, as shown in FIGS. 5 and 6B, a width in a longer-width direction (the axial direction) of the spiral spring 33 is a spring width W1, and a width (a thickness) in a shorter-width direction (a radial direction) of the spiral spring 33 is a spring thickness T.

The first engaging end 33*b* is inserted into the stopper groove 17 of the tubular protrusion 16, and is engaged with and fixed to the opposing surface 17*a* having the arc surface. The second engaging end 33*c* is engaged with and fixed to an outer peripheral surface of the umbrella pin 13 provided on the outer end surface 11*c* of the front plate 11. The spiral spring 33 is set so as to force the vane rotor 7 in the advanced angle direction all the time by a spring force of the spiral spring 33.

This spiral spring 33 is also set so as to be shrunk (so as to be deformed in a spiral shrinking direction) when the vane rotor 7 relatively rotates with respect to the housing 5 in a retarded angle direction.

Further, as shown in FIG. 4, a support pin 34, which assists a forcing action of the spiral spring 33 by increasing torque generated at the spiral spring 33, is provided on the outer end surface 11*c* of the front plate 11.

This support pin 34 is formed into an almost cylindrical shape, and is press-fitted to the outer end surface 11*c* in a position spaced apart from the umbrella pin 13 at a predetermined angle. The spiral spring 33 is set so that the outermost circumferential portion 33*f* of the spiral spring 33 is contiguous to or touches an outer circumferential surface of the support pin 34. With this setting, when the spiral spring 33 is shrunk (when the shape of the spiral spring 33 is changed in the spiral shrinking direction), the torque generated at a section from a contact point between the support pin 34 and the spiral spring 33 to the second engaging end 33*c* is increased.

In addition, as shown in FIGS. 1, 4 to 6A, 6B, a ring-shaped groove 35 that is a recessed portion (an engagement groove), which accommodates therein the innermost circumferential portion 33*d* of the spiral spring 33, is provided on the outer peripheral surface of the tubular protrusion 16.

This ring-shaped groove 35 is formed throughout almost the entire circumference of the tubular protrusion 16 by a cutting process, as can be seen in FIG. 4. The ring-shaped groove 35 is formed from an almost cylindrical bottom surface 35*a* having a smaller diameter than the tubular protrusion 16, one side wall surface 35*b* and the other side wall surface 35*c*. The one side wall surface 35*b* is one side wall portion that stands from an edge, at a top end side (the top end portion 16*a* side) of the tubular protrusion 16, of the bottom surface 35*a* at a perpendicular angle to the edge of the bottom surface 35*a*. The other side wall surface 35*c* is the other side wall portion that stands from an edge, at a base end portion 16*b* side of the tubular protrusion 16, which is an opposite side to the top end portion 16*a*, of the bottom surface 35*a* at a perpendicular angle to the edge of the bottom surface 35*a*.

As shown in FIG. 6B, the ring-shaped groove 35 is formed so as to have a predetermined groove width W2 that is longer (wider) than the spring width W1 of the spiral spring 33. More specifically, the other side wall surface 35*c* of the ring-shaped groove 35 is set in a closer position to the base end portion 16*b* with respect to the outer end surface 11*c* of the front plate 11. Further, a groove width W3 of the ring-shaped groove 35, which is a width from the outer end surface 11*c* of the front plate 11 to the one side wall surface 35*b*, is set to be longer (wider) than the spring width W1 of the spiral spring 33. With these settings, the spiral spring 33 can be inserted into the ring-shaped groove 35 and engaged with an inside of the ring-shaped groove 35.

In the present embodiment, as described above, the other side wall surface 35*c* of the ring-shaped groove 35 is set in the closer position to the base end portion 16*b* with respect to the outer end surface 11*c* of the front plate 11. However, the position of the other side wall surface 35*c* is not limited to this as long as the other side wall surface 35*c* is not located in a closer position to the top end portion 16*a* with respect to the outer end surface 11*c*. For instance, the other side wall surface 35*c* could be set so as to have a same flat surface as the outer end surface 11*c* (i.e. W2=W3).

Further, as shown in FIGS. 5 and 6B, the ring-shaped groove 35 is formed so that a groove depth D of the ring-shaped groove 35 is shallower than the spring thickness T of the spiral spring 33. More specifically, the groove depth D is set so that when the innermost circumferential portion 33*d* of the spiral spring 33 is inserted into the ring-shaped groove 35, a radially outer side of the innermost circumferential portion 33*d* comes out of or protrudes from (or is exposed from) the ring-shaped groove 35 all the time.

At this time, since the spiral spring 33 has the spiral shape that gradually widens or expands from the inner circumferential side to the outer circumferential side, although the spiral spring 33 is contiguous to or touches the bottom surface 35*a* of the ring-shaped groove 35 in the vicinity of the first engaging end 33*b*, the spiral spring 33 is gradually separated from the bottom surface 35*a* as the spiral spring 33 widens to the outer circumferential side.

Therefore, a protruding portion (an exposed portion) of the spiral spring 33, which protrudes from (or is exposed from) the ring-shaped groove 35, gradually becomes large (a protruding amount is gradually increased) from the first engaging end 33*b* of the spiral spring 33 toward the outer circumferential side, and finally the spiral spring 33 is completely separated from the ring-shaped groove 35.

In the present embodiment, as shown by "R" in FIG. 4, the spiral spring 33 is set so that the innermost circumferential portion 33*d* is inserted in and engaged with the ring-shaped groove 35 throughout a range from a position around or close to the first engaging end 33*b* to a substantially 180 degree position (a substantially 180° position) to the outer circumferential side, and the spiral spring 33 is separated from the ring-shaped groove 35 from the substantially 180° position.

Operation and Effect of the Present Embodiment

Next, working or operation and effect of the present embodiment will be explained in detail.

At an engine start, as shown in FIG. 2, the vane rotor 7 is forced at the most-advanced angle position by the spring force of the spiral spring 33, and in a state of this position of the vane rotor 7, the top end portion 29*a* of the lock pin 29 is previously inserted into and engaged with the locking hole 30. The position of the vane rotor 7 is therefore stably restrained at the advanced angle side relative rotation position which is suitable for the engine start. Since the valve timing of the exhaust valve is controlled to the most-advanced angle side in this way, during the engine start by turning or pushing an ignition switch, good engine startability can be ensured by the smooth cranking.

When the engine operating condition is, for instance, in a low rotation speed low load region after the engine start, no-current application state of the electromagnetic coil of the electromagnetic switching valve 22 is maintained by the electronic controller. With this control, the oil outlet passage 21*a* of the oil pump 21 and the retard oil passage 19 are connected to each other, and also the advance oil passage 20 and the oil drain passage 23 are connected to each other.

The working fluid flowing from the oil pump 21 thus flows into each retard oil chamber 9 through the retard oil passage 19, then each retard oil chamber 9 becomes a high pressure. On the other hand, the working fluid in each advance oil chamber 10 is discharged in the oil pan 24 from the oil drain passage 23 through the advance oil passage 20, then each advance oil chamber 10 becomes a low pressure.

At this time, the working fluid flowing into each retard oil chamber 9 also flows into the pressure-receiving space 32 and the locking hole 30 from the lock cancelling hydraulic circuit and the pressure-receiving space 32 becomes the high pressure. The top end portion 29*a* of the lock pin 29 then moves in the backward direction and comes out of the locking hole 30 (is disengaged with the locking hole 30), thereby allowing the free rotation of the vane rotor 7.

Thus, as shown in FIG. 3, when the vane rotor 7 rotates to the retarded angle side (in a counter-clockwise direction in the drawing) with increase or expansion of volume of the retard oil chamber 9 against the spring force of the spiral spring 33, the one side surface of the first vane 15*a* touches (or is pressed against) the opposing side surface of the first shoe 8*a* which faces the one side surface of the first vane 15*a* in the circumferential direction, the rotation position at the most-retarded angle side of the vane rotor 7 is then limited. With this operation and working, the relative rotational angle (the relative rotational phase) of the camshaft 2 (the vane rotor 7) with respect to the housing 5 is converted to the most-retarded angle side.

Here, since the vane rotor 7 relatively rotates to the retarded angle side with respect to the housing 5, the spiral spring 33 is deformed (the shape of the spiral spring 33 is changed) in a diameter-reducing direction (in the spiral shrinking direction).

Next, when the engine operating condition is, for instance, in a high rotation speed high load region, the electronic controller outputs the control current to the electromagnetic switching valve 22, and the oil outlet passage 21*a* of the oil pump 21 and the advance oil passage 20 are connected to each other, also the retard oil passage 19 and the oil drain passage 23 are connected to each other. With this operation, the working fluid in the retard oil chamber 9 is exhausted in the oil pan 24, then each retard oil chamber 9 becomes the low pressure. On the other hand, the working fluid is supplied to the advance oil chamber 10, then each advance oil chamber 10 becomes the high pressure. At this time, since the working fluid (the hydraulic pressure) is supplied to the locking hole 30 from the advance oil chamber 10 through the lock cancelling hydraulic circuit, a disengagement state in which the lock pin 29 comes out of the locking hole 30 by this hydraulic pressure is maintained.

Thus, as shown in FIG. 2, when the vane rotor 7 rotates to the advanced angle side (in a clockwise direction in the drawing) with increase or expansion of volume of the advance oil chamber 10 together with the spring force generated due to the shrink of the spiral spring 33, the other side surface of the first vane 15*a* touches (or is pressed against) the opposing side surface of the second shoe 8*b* which faces the other side surface of the first vane 15*a* in the circumferential direction, the rotation position at the most-advanced angle side of the vane rotor 7 is then limited. With this operation and working, the relative rotational angle (the relative rotational phase) of the camshaft 2 (the vane rotor 7) with respect to the housing 5 is converted to the most-advanced angle side. As a consequence, open and closing timing of the exhaust valve is controlled to the most-advanced angle side, and an output of the engine in the high rotation speed high load region can be increased.

Further, just before an engine stop, the working fluid (the hydraulic pressure) is exhausted in the oil pan 24 from each of the retard and advance oil chambers 9 and 10 through the oil drain passage 23, and the hydraulic pressure in the pressure-receiving space 32 and the locking hole 30 also decreases. As a result, the vane rotor 7 relatively rotates to the most-advanced angle side by the spring force of the spiral spring 33 which acts on the camshaft 2, and the lock pin 29 moves in the forward direction by a spring force of the coil spring 31 and the top end portion 29*a* is inserted into and engaged with the locking hole 30.

In this case, since exact positioning, in the circumferential direction, of the housing 5 by the lock pin 29 and the locking hole 30 is achieved when assembling each component, smooth engagement of the lock pin 29 can be ensured.

In the present embodiment, as described above, the tubular protrusion 16 is formed at the front end surface 14*a* side of the rotor 14 forming the vane rotor 7, and the ring-shaped groove 35 is formed at the top end portion 16*a* of the tubular protrusion 16, then a part of the innermost circumferential portion 33*d* of the spiral spring 33 is inserted into or fitted to the inside of the ring-shaped groove 35.

The innermost circumferential portion 33*d* of the spiral spring 33, which is accommodated in the ring-shaped groove 35, tends to move to the front side of the variable valve timing control apparatus from the outer end surface 11*c* of the front plate 11 when the spiral spring 33 is shrunk or widens. However, by the fact that a side surface (an end surface) of the spiral spring 33, which is opposite to the front plate 11, is made contact with or touches the one side wall surface 35*b* of the ring-shaped groove 35, the coming-off of the spiral spring 33 to the front side of the apparatus is avoided.

In this manner, in the present embodiment, unlike the structure of the related art in which the cover portion provided as a separate component from the vane rotor is fixed to the vane rotor, the vane rotor 7 in itself has the engagement portion (the ring-shaped groove 35) in which the innermost circumferential portion 33*d* of the spiral spring 33 is accommodated. Thus, the component count can be reduced, and the manufacturing operation and the assembly operation are facilitated. Also cost associated with these can be reduced.

Further, in the present embodiment, since the second engaging end 33*c* of the spiral spring 33 is wound around and engaged with the umbrella pin 13, the coming-off of the spiral spring 33 to the front side of the apparatus is avoided also by the umbrella portion 13*b*.

That is, in the present embodiment, not only by the innermost circumferential portion 33*d* of the spiral spring 33 but also by the second engaging end 33*c* that is an engaging end portion at the outermost circumferential portion 33*f* side, the coming-off of the spiral spring 33 to the front side of the apparatus is avoided. Therefore, the coming-off of the spiral spring 33 is surely suppressed.

In addition, since the ring-shaped groove 35 is formed so that only a part of the innermost circumferential portion 33*d* of the spiral spring 33 is inserted into or fitted to the inside of the ring-shaped groove 35, even though the spiral spring 33 moves to the front side of the apparatus and is made contact with or touches the one side wall surface 35*b* of the ring-shaped groove 35, its contact area is extremely small.

Therefore, a friction that might be generated between the spiral spring 33 and the one side wall surface 35*b* of the ring-shaped groove 35 can be greatly reduced.

Especially in the present embodiment, as shown in FIGS. 5 and 6B, since the ring-shaped groove 35 is formed so that the groove depth D of the ring-shaped groove 35 is shallower than the spring thickness T of the spiral spring 33, an accommodating area or an inserting area between the spiral spring 33 and the ring-shaped groove 35 is further reduced.

Therefore, a friction that might be generated between the spiral spring 33 and the ring-shaped groove 35 can be greatly reduced.

Although the ring-shaped groove 35 is formed throughout almost the entire circumference of the tubular protrusion 16 in the present embodiment, the ring-shaped groove 35 is not necessarily formed throughout almost the entire circumference of the tubular protrusion 16. The ring-shaped groove 35 could be formed throughout a certain circumferential direction range required to at least avoid the coming-off of the spiral spring 33 to the front side of the apparatus.

Second Embodiment

Figure 7:
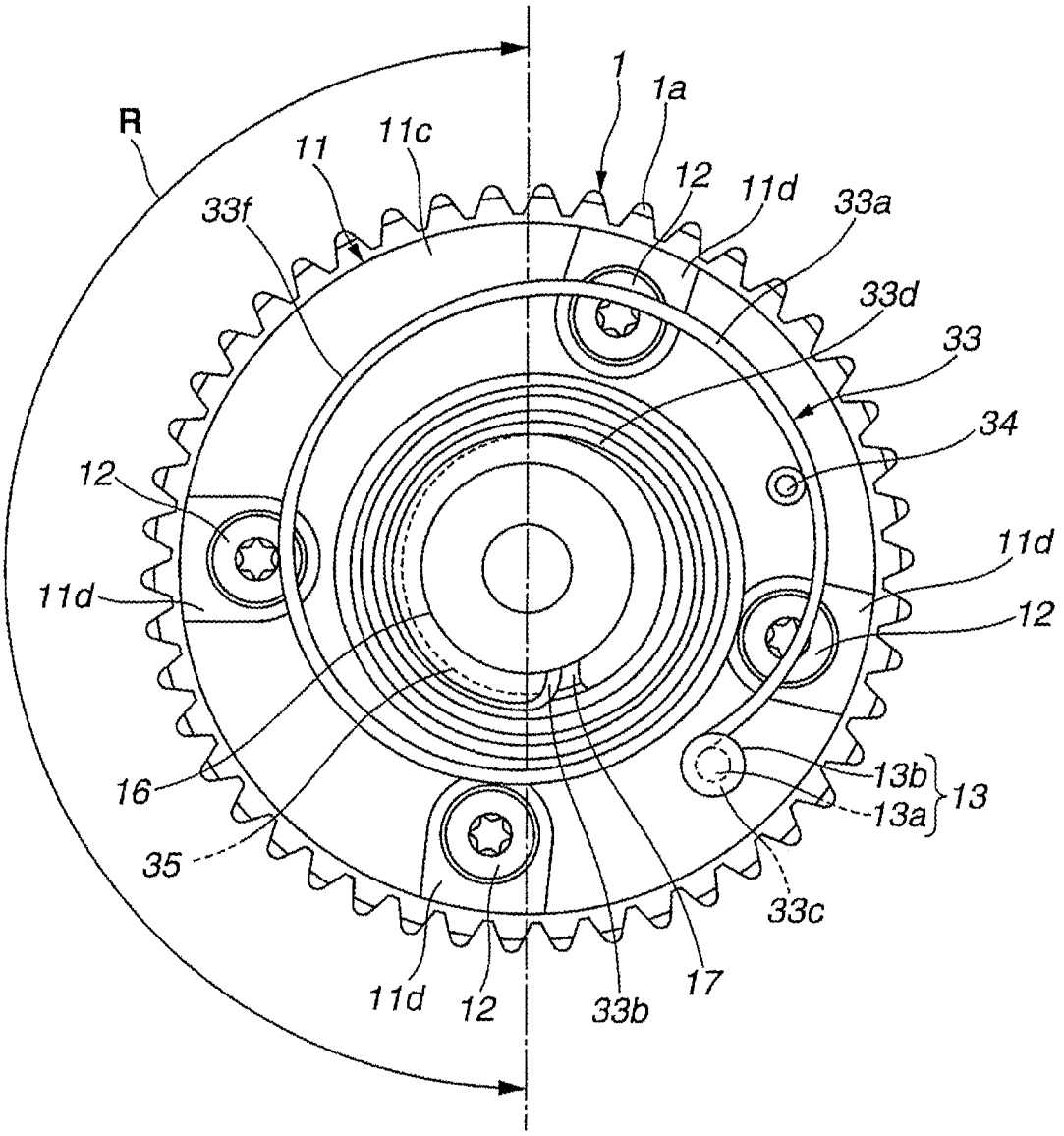
FIG. 7 is a front view of the variable valve timing control apparatus according to a second embodiment of the present invention.

FIG. 7 shows a second embodiment. A structure or configuration of the second embodiment is basically same as that of the first embodiment. However, in the second embodiment, the ring-shaped groove 35 of the tubular protrusion 16 has a different shape from that of the first embodiment.

As shown in FIG. 7, although the ring-shaped groove 35 is formed so that the groove depth D of the ring-shaped groove 35 in the vicinity of the stopper groove 17 is the same depth as that of the first embodiment, the groove depth of the ring-shaped groove 35 is gradually shallower from this point in the vicinity of the stopper groove 17 in a spring wound outer circumferential direction, i.e. in a range from the stopper groove 17 to a substantially 180° position in the circumferential direction, and finally the groove disappears in the substantially 180° position in the circumferential direction.

That is, the ring-shaped groove 35 is formed by cutting the outer peripheral surface of the tubular protrusion 16 by a certain circumferential direction range required to avoid the coming-off of the spiral spring 33, namely a circumferential direction range where the spiral spring 33 is actually inserted or accommodated, so that the groove depth is gradually shallower in this circumferential direction range.

Accordingly, also in the present embodiment, the same operation and effect as those of the first embodiment can be obtained. Further, since a cutting amount of the outer peripheral surface of the tubular protrusion 16 for the ring-shaped groove 35 is smaller than the first embodiment, cost associated with the cutting process can be reduced.

Third Embodiment

Figure 8:
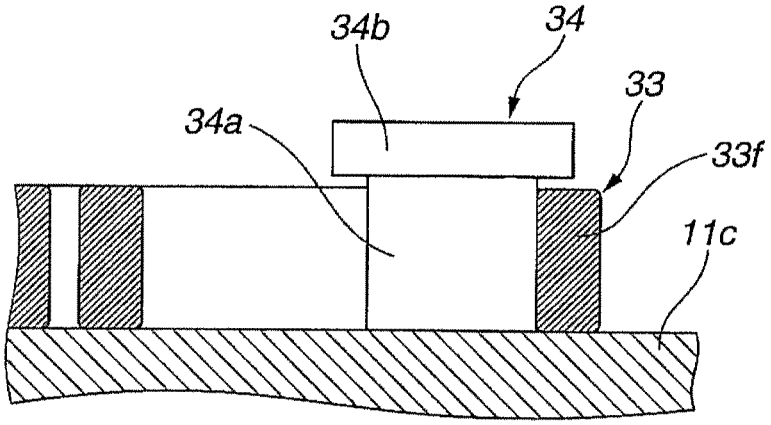
FIG. 8 is a sectional view showing a support pin of the variable valve timing control apparatus according to a third embodiment of the present invention.

FIG. 8 shows a third embodiment. A structure or configuration of the third embodiment is basically same as that of the first embodiment. However, in the third embodiment, a structure of the support pin 34 is different. As shown in FIG. 8, the support pin 34 has a cylindrical pin body 34*a* and a disc-shaped umbrella portion 34*b* provided on a top surface of the pin body 34*a* which is an opposite side to a press-fixed side of the pin body 34*a*.

That is, the support pin 34 has almost the same shape as the umbrella pin 13, and a part of the outermost circumferential portion 33*f* of the spiral spring 33 is contiguous to or touches an outer circumferential surface of the pin body 34*a*. In this contact position, by the pin body 34*a*, the coming-off of the spiral spring 33 to the front side of the apparatus is avoided.

Accordingly, in the present embodiment, since the coming-off of the spiral spring 33 to the front side of the apparatus is avoided also by the support pin 34, it is possible to surely hold the spiral spring 33.

The present invention is not limited to the above embodiment, and the above embodiment can be modified.

For instance, in the embodiments described above, as the spiral spring 33, the plate spiral spring is used. However, the spiral spring 33 is not limited to this plate spiral spring, and a spiral spring having a circular cross-section could be used.

Further, in the above embodiments, as the tubular protrusion 16 (the extending portion), the almost cylindrical-shaped tubular protrusion is formed. However, the tubular protrusion 16 is not limited to the cylindrical-shaped tubular protrusion as long as the tubular protrusion has a groove whose top end portion can accommodate the spiral spring 33. For instance, a tubular protrusion formed into a square or rectangular tube is possible.

Moreover, in the above embodiments, as shown by "R" in FIGS. 4 and 7, the spiral spring 33 is set so that the innermost circumferential portion 33*d* is inserted in and engaged with the ring-shaped groove 35 throughout the range from the position around or close to the first engaging end 33*b* to the substantially 180° position to the outer circumferential side, and the spiral spring 33 is separated from the ring-shaped groove 35 from the substantially 180° position. However, the range where the spiral spring 33 is inserted in and engaged with the ring-shaped groove 35 can be changed depending on shapes of the spiral spring 33 and the ring-shaped groove 35.

Furthermore, in the above embodiments, the spiral spring 33 forcing the vane rotor 7 in the advanced angle direction with respect to the housing 5 all the time by the spring force is used. However, the spiral spring 33 that forces the vane rotor 7 in the retarded angle direction could be used.

In addition, the other side wall surface 35*c* of the ring-shaped groove 35 could be set so as to have a same flat surface as an axial direction contact surface of the front plate 11 of the vane rotor 7.

In the above embodiments, the variable valve timing control apparatus is applied to the variable valve system for the exhaust valve side of the internal combustion engine. However, the variable valve timing control apparatus can be applied to the variable valve system for the intake valve side of the internal combustion engine.

From the foregoing, the present invention includes the following structure or configuration of the variable valve timing control apparatus, and has the following effects.

(a) In the variable valve timing control apparatus, one side wall surface (35*c*), located on the vane rotor (7) side, of the pair of side wall surfaces (35*b*, 35*c*) of the recessed portion (35) is formed so as to have a same flat surface as an outer surface of the drive rotary member (5), or is formed in a closer position to the vane rotor (7) with respect to the outer surface of the drive rotary member (5).

With this structure or configuration, it is possible to avoid the innermost circumferential portion 33*d* of the spiral spring 33 tilting and separating from the recessed portion 35 to the outer circumferential side. Thus, the spiral spring 33 can be stably shrunk and widen. This suppresses the occurrence itself of movement, to the front side of the apparatus, of the spiral spring 33, and the coming-off of the spiral spring 33 is surely suppressed.

(b) In the variable valve timing control apparatus, a side surface, on the vane rotor (7) side, of the spiral spring (33) is made contact with the outer surface of the drive rotary member (5).

With this structure or configuration, since the outer surface of the drive rotary member 5 acts as a seating surface of the spiral spring 33, the spiral spring 33 can be stably shrunk and widen. The coming-off of the spiral spring 33 to the front side of the apparatus is therefore surely avoided.

(c) In the variable valve timing control apparatus, the spiral spring (33) has a substantially plate shape in cross-section.

(d) In the variable valve timing control apparatus, the stopper (17) is formed so as to penetrate the tubular portion (16) in the radial direction from an inner peripheral surface to the outer peripheral surface of the tubular portion (16).

(e) In the variable valve timing control apparatus, the stopper (17) has opposing surfaces (17*a*, 17*b*), and one opposing surface (17*a*) of the opposing surfaces (17*a*, 17*b*), with which the engaging end (33*b*) of the innermost circumferential portion (33*d*) is engaged, is shaped into an arc surface.

The entire contents of Japanese Patent Application No. 2014-183757 filed on Sep. 10, 2014 are incorporated herein by reference.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. A variable valve timing control apparatus of an internal combustion engine, comprising:

a drive rotary member to which a turning force is transmitted from an engine crankshaft and which has therein working chambers;

a vane rotor relatively rotatably housed in the drive rotary member and defining the working chambers as a retard working chamber and an advance working chamber, the vane rotor having (a) a tubular portion that is formed integrally with the vane rotor and protrudes from a middle position of one end side in an axial direction of the vane rotor to an outside of the drive rotary member; and (b) a recessed portion that is formed on an outer peripheral surface of the tubular portion and is recessed in a radially inward direction on the outer peripheral surface of the tubular portion, the recessed portion having side wall surfaces on both sides in the axial direction of the recessed portion; and a spiral spring forcing the vane rotor all the time in one rotation direction with respect to the drive rotary member, and an engaging end of an outermost circumferential portion of the spiral spring being engaged with the drive rotary member, and an engaging end of an innermost circumferential portion of the spiral spring being engaged with the tubular portion, and a part of the innermost circumferential portion of the spiral spring being inserted in the recessed portion.

2. The variable valve timing control apparatus of the internal combustion engine as claimed in claim 1, wherein:

a depth of the recessed portion is set to be shallower than a thickness in a radial direction of the spiral spring.

3. The variable valve timing control apparatus of the internal combustion engine as claimed in claim 2, wherein:

the recessed portion is formed throughout a circumferential direction range of at least 180° on the outer peripheral surface of the tubular portion.

4. The variable valve timing control apparatus of the internal combustion engine as claimed in claim 3, wherein:

the innermost circumferential portion of the spiral spring is inserted in the recessed portion throughout the circumferential direction range of at least 180°.

5. The variable valve timing control apparatus of the internal combustion engine as claimed in claim 4, wherein:

the innermost circumferential portion of the spiral spring is separated from the recessed portion to a radially outward direction within a circumferential direction range of 180° to 360° from the engaging end of the innermost circumferential portion in a spring wound outer circumferential direction.

6. The variable valve timing control apparatus of the internal combustion engine as claimed in claim 3, wherein:

the recessed portion is formed throughout a substantially entire circumference of the tubular portion.

7. The variable valve timing control apparatus of the internal combustion engine as claimed in claim 3, wherein:

the depth of the recessed portion is set to be gradually shallower in a spring wound outer circumferential direction.

8. The variable valve timing control apparatus of the internal combustion engine as claimed in claim 1, wherein:

the engaging end of the innermost circumferential portion of the spiral spring is formed by being curved in a radially inward direction of the spiral spring, a stopper is formed in a predetermined position in a circumferential direction of the recessed portion by cutting the tubular portion from a bottom surface of the recessed portion toward a radially inward direction, and the engaging end of the innermost circumferential portion is inserted into and engaged with the stopper.

9. The variable valve timing control apparatus of the internal combustion engine as claimed in claim 8, wherein:

the stopper is formed so as to penetrate the tubular portion in the radial direction from an inner peripheral surface to the outer peripheral surface of the tubular portion.

10. The variable valve timing control apparatus of the internal combustion engine as claimed in claim 9, wherein:

the stopper has opposing surfaces, and one opposing surface of the opposing surfaces, with which the engaging end of the innermost circumferential portion is engaged, is shaped into an arc surface.

11. The variable valve timing control apparatus of the internal combustion engine as claimed in claim 1, wherein:

one side wall surface, located on the vane rotor side, of the pair of side wall surfaces of the recessed portion is formed so as to have a same flat surface as an outer surface of the drive rotary member, or is formed in a closer position to the vane rotor with respect to the outer surface of the drive rotary member.

12. The variable valve timing control apparatus of the internal combustion engine as claimed in claim 11, wherein:

a side surface, on the vane rotor side, of the spiral spring is made contact with the outer surface of the drive rotary member.

13. The variable valve timing control apparatus of the internal combustion engine as claimed in claim 1, wherein:

the spiral spring has a substantially plate shape in cross-section.

14. A variable valve timing control apparatus of an internal combustion engine, comprising:

a cylindrical housing to which a turning force is transmitted from an engine crankshaft and which has a plurality of shoes formed on an inner circumferential surface of the housing so as to protrude in a radially inward direction;

a vane rotor including (a) a rotor that is secured to a camshaft, the rotor having (i) an extending portion that is formed integrally with the rotor and protrudes from a middle position of one end side in an axial direction of the rotor to an outside of the housing; and (ii) an engagement groove that is formed on a part of an outer peripheral surface of the extending portion and is recessed in a radially inward direction on the outer peripheral surface of the extending portion throughout a predetermined circumferential direction range; and (b) a plurality of vanes that are formed on an outer circumferential surface of the rotor so as to protrude in a radially outward direction, the vanes defining a retard working chamber and an advance working chamber between the adjacent two shoes; and a spiral spring forcing the vane rotor all the time in one rotation direction with respect to the housing, and an engaging end of an outermost circumferential portion of the spiral spring being engaged with the housing, and an engaging end of an innermost circumferential portion of the spiral spring being engaged with the extending portion, and a part of the innermost circumferential portion of the spiral spring being inserted in the engagement groove.

15. The variable valve timing control apparatus of the internal combustion engine as claimed in claim 14, wherein:

a depth of the engagement groove is set to be shallower than a thickness in a radial direction of the spiral spring.

* * * * *